US012329292B1

(12) United States Patent
Zhang

(10) Patent No.: US 12,329,292 B1
(45) Date of Patent: Jun. 17, 2025

(54) SIDE STRUCTURE, PLAYPEN FRAME AND PLAYPEN

(71) Applicant: XIAMEN HONOR INDUSTRY AND TRADING CO., LTD, Xiamen (CN)

(72) Inventor: Jian Yong Zhang, Xiamen (CN)

(73) Assignee: XIAMEN HONOR INDUSTRY AND TRADING CO., LTD, Xiamen (CN)

( * ) Notice: Subject to any disclaimer, the term of this patent is extended or adjusted under 35 U.S.C. 154(b) by 0 days.

(21) Appl. No.: 19/063,367

(22) Filed: Feb. 26, 2025

(30) Foreign Application Priority Data

Dec. 13, 2024 (CN) ..... 202423086098.5

(51) Int. Cl.
*A47D 13/06* (2006.01)

(52) U.S. Cl.
CPC ..... *A47D 13/061* (2013.01)

(58) Field of Classification Search
CPC . A47D 7/00; A47D 7/002; A47D 9/00; A47D 9/005; A47D 11/007; A47D 13/00; A47D 13/06; A47D 13/061; A47D 13/063; A47D 13/065; A47D 13/066; A47D 13/068
See application file for complete search history.

(56) References Cited

U.S. PATENT DOCUMENTS

| | | | | |
|---|---|---|---|---|
| 3,092,847 | A * | 6/1963 | De Puy | A47D 13/063 5/98.1 |
| 4,683,600 | A * | 8/1987 | Beger | A47D 7/002 5/99.1 |
| 9,907,411 | B2 * | 3/2018 | Burns | A47D 13/061 |
| 2005/0150053 | A1 * | 7/2005 | Hartenstine | A47B 9/06 5/655 |
| 2012/0216346 | A1 * | 8/2012 | Rampton | A47D 13/061 256/25 |
| 2014/0068857 | A1 * | 3/2014 | Jackson | A47D 13/063 5/98.1 |
| 2017/0290444 | A1 * | 10/2017 | Mao | A47D 13/063 |
| 2020/0187673 | A1 * | 6/2020 | Thorne | F16C 11/10 |

* cited by examiner

*Primary Examiner* — George Sun
(74) *Attorney, Agent, or Firm* — Jose Cherson Weissbrot

(57) ABSTRACT

A side structure includes: a middle vertical rod arranged vertically after being unfolded; a first lower horizontal rod arranged horizontally after being unfolded; a second lower horizontal rod arranged horizontally after being unfolded; a sliding support base, wherein a first sliding groove slidably connected to the middle vertical rod is provided in the middle part of the sliding support base, the sliding support base can slide along the middle vertical rod, and the first lower horizontal rod and the second lower horizontal rod are hinged on the left and right sides of the sliding support base; a triangular support sliding assembly, wherein the triangular support sliding assembly includes a sliding sleeve, a first diagonal brace and a second diagonal brace, and the sliding sleeve is slidably sleeved on the outer wall of the middle vertical rod.

20 Claims, 6 Drawing Sheets

SIDE STRUCTURE, PLAYPEN FRAME AND PLAYPEN

CROSS REFERENCE TO THE RELATED APPLICATIONS

This application is based upon and claims priority to Chinese patent application No. 202423086098.5, filed on Dec. 13, 2024, the entire contents of which are incorporated herein by reference.

TECHNICAL FIELD

The present invention relates to the field of playpens, in particular to a side structure, a playpen frame and a playpen.

BACKGROUND ART

For young children who have just learned to crawl or walk, it is very necessary to use a child playpen to confine them to a specific safe zone when playing. Most of the existing child playpens are composed of railing plates by assembling. During the transporting process, these child playpens are typically disassembled into separate railing plates for transportation, and thus consumers need to assemble them after purchase. During the process of unfolding and using, the side structure of the playpen is likely to topple over, especially when there is external force or strong wind, thereby lowering the safety and reliability of the playpen.

SUMMARY OF THE INVENTION

In view of this, a side structure, a playpen frame and a playpen are provided to solve the problem that the existing playpen is easy to topple over.

To achieve the above-mentioned object, the present invention provides a side structure of a playpen frame, including:

- a middle vertical rod, wherein the middle vertical rod is arranged vertically after being unfolded;
- a first lower horizontal rod, wherein the first lower horizontal rod is arranged horizontally after being unfolded;
- a second lower horizontal rod, wherein the second lower horizontal rod is arranged horizontally after being unfolded;
- a sliding support base, wherein a first sliding groove slidably connected to the middle vertical rod is provided in a middle of the sliding support base, the sliding support base is allowed to slide along the middle vertical rod, and the first lower horizontal rod and the second lower horizontal rod are hinged to left and right sides of the sliding support base; and
- a triangular support sliding assembly, wherein the triangular support sliding assembly includes a sliding sleeve, a first diagonal brace and a second diagonal brace, the sliding sleeve is slidably connected to the outer wall of the middle vertical rod and can slide along the middle vertical rod, the first diagonal brace and the second diagonal brace are hinged to left and right sides of the sliding sleeve, one end of the first diagonal brace away from the sliding sleeve is hinged to the first lower horizontal rod, and one end of the second diagonal brace away from the sliding sleeve is hinged to the second lower horizontal rod.

Further, a trapezoidal handle structure protruding toward an outside of the side structure is provided between the first diagonal brace and the second diagonal brace.

Further, a first limiting wall is provided above a portion where the first lower horizontal rod is hinged to the sliding support base; the first limiting wall limits the first lower horizontal rod from turning upward so that the first lower horizontal rod is arranged horizontally after being unfolded; a second limiting wall is provided above a portion where the second lower horizontal rod is hinged to the sliding support base; the second limiting wall limits the second lower horizontal rod from turning upward so that the second lower horizontal rod is arranged horizontally after being unfolded.

Further, a first locking structure is provided on the sliding sleeve, and the first locking structure is used to lock the sliding sleeve on the middle vertical rod, or unlock the sliding sleeve and the middle vertical rod.

Further, the sliding sleeve is slidably connected to the middle vertical rod through a second sliding groove inside the sliding sleeve, a side of the second sliding groove is provided with an opening, the sliding sleeve is provided with a stopper beside a position of the opening of the second sliding groove, the sliding sleeve is provided with a first elastic sheet beside the position of the opening of the second sliding groove, the middle vertical rod is provided with a first elastic part allowed to extend and retract in a horizontal direction, and the stopper, the first elastic sheet, and the first elastic part form the first locking structure;

- wherein, the first elastic part protrudes out of the middle vertical rod and presses against the stopper without external force to achieve a locking function; when the sliding sleeve is locked on the middle vertical rod, the first elastic sheet is placed corresponding to the first elastic part, and the first elastic sheet is pressed to push the first elastic part into the middle vertical rod to achieve an unlocking function.

Further, the first elastic part includes a first protrusion and a first elastic structure; the first elastic structure is a V-shaped elastic sheet, one end of the first elastic structure presses against the middle vertical rod, and the other end of the first elastic structure is fixed with the first protrusion; the first protrusion is allowed to protrude outside the middle vertical rod to press against the stopper.

Further, at least two first elastic parts are provided, and are respectively arranged on upper and lower sides of the middle vertical rod.

Further, a second locking structure is provided on the sliding support base, and the second locking structure is used to lock the sliding support base on the middle vertical rod, or unlock the sliding support base and the middle vertical rod.

Further, a side of a first sliding groove is provided with an opening, the sliding support base is provided with a second elastic sheet beside a position of the opening of the first sliding groove, the middle vertical rod is provided with a second elastic part allowed to extend and retract in the horizontal direction, and the second elastic sheet and the second elastic part form the second locking structure;

- wherein, the second elastic part protrudes outside the middle vertical rod and presses against the second elastic sheet without external force to achieve a locking function; when the sliding support base is locked on the middle vertical rod, the second elastic sheet is placed corresponding to the second elastic part, and the second elastic sheet is pressed to push the second elastic part into the middle vertical rod to achieve an unlocking function.

Further, the side structure also includes a middle connecting part, a first upper horizontal rod, a second upper horizontal rod, a first vertical rod, a second vertical rod, a first upper connecting part, a first lower connecting part, a second upper connecting part and a second lower connecting part, wherein the first upper horizontal rod and the second upper horizontal rod are hinged to left and right sides of the middle connecting part, an upper end of the first vertical rod is hinged to an end of the first upper horizontal rod away from the middle connecting part through the first upper connecting part, a lower end of the first vertical rod is hinged to an end of the first lower horizontal rod away from the sliding support base through the first lower connecting part, an upper end of the second vertical rod is hinged to an end of the second upper horizontal rod away from the middle connecting part through the second upper connecting part, and a lower end of the second vertical rod is hinged to an end of the second lower horizontal rod away from the sliding support base through the second lower connecting part.

To achieve the above-mentioned purpose, the present invention provides a playpen frame, including four side structures of a playpen frame as described in the above-mentioned embodiment, wherein two adjacent side structures share one first upper connecting part, one first lower connecting part, one second upper connecting part, one second lower connecting part, one first vertical rod, and one second vertical rod, and the four side structures are unfolded to form a cubic shape.

To achieve the above objectives, the present invention provides a playpen, including the playpen frame described in the above embodiment and a fabric cover covering the sides and bottom of the playpen frame.

The above technical solution has the following advantages:

The playpen frame can be unfolded by sliding the sliding support base and the sliding sleeve on the middle vertical rod to the lower end and swinging the first lower horizontal rod and the second lower horizontal rod. The middle vertical rod ensures the height of the playpen. The first lower horizontal rod and the second lower horizontal rod provide horizontal support for the playpen. The first diagonal brace and the second diagonal brace combined with the first lower horizontal rod and the second lower horizontal rod respectively form a plurality of triangular support structures. These triangular structures offer stability to enhance the stability of the side portion of the entire playpen.

Figure 1:
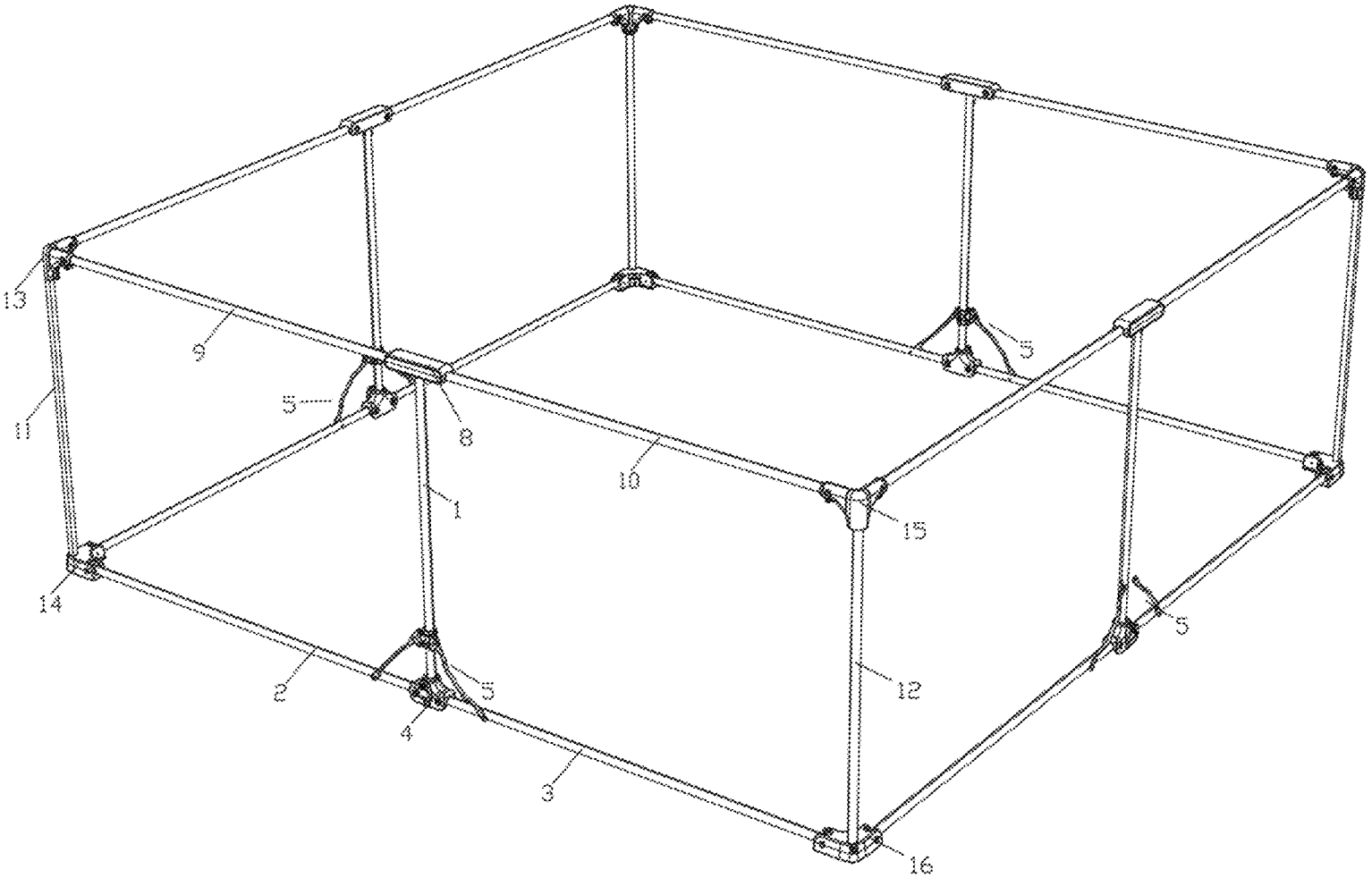
FIG. 1 is a structural schematic diagram of a playpen in an unfolded configuration in this embodiment.

Descriptions of reference numerals:

1. Middle vertical rod;
2. First lower horizontal rod;
3. Second lower horizontal rod;
4. Sliding support base; 41. First sliding groove; 42. First limiting wall; 43. Second limiting wall;
5. Triangular support sliding assembly; 51. Sliding sleeve; 511. Second sliding groove; 52. First diagonal brace; 53. Second diagonal brace; 54. Trapezoidal handle structure;
6. First locking structure; 61. First elastic sheet; 62. First elastic part; 63. stopper;
7. Second locking structure; 71. Second elastic sheet; 72. Second elastic part;
8. Middle connecting part;
9. First upper horizontal rod;
10. Second upper horizontal rod;
11. First vertical rod;
12. Second vertical rod;
13. First upper connecting part;
14. First lower connecting part;
15. Second upper connecting part; and
16. Second lower connecting part.

DETAILED DESCRIPTION OF THE EMBODIMENTS

In order to explain the technical content, structural features, achieved objectives and effects of the technical solution in detail, a detailed description with specific embodiments and drawings is provided below.

As shown in FIGS. 1 to 9, this embodiment provides a side structure of a playpen frame, including:

a middle vertical rod 1, wherein the middle vertical rod 1 is arranged vertically after being unfolded;

a first lower horizontal rod 2, wherein the first lower horizontal rod 2 is arranged in a horizontal direction after being unfolded;

a second lower horizontal rod 3, wherein the second lower horizontal rod 3 is arranged in the horizontal direction after being unfolded;

a sliding support base 4, wherein a first sliding groove 41 slidably connected to the middle vertical rod 1 is provided in the middle of the sliding support base 4, the sliding support base 4 can slide along the middle vertical rod 1, and the first lower horizontal rod 2 and the second lower horizontal rod 3 are hinged to the left and right sides of the sliding support base 4; and a triangular support sliding assembly 5, wherein the triangular support sliding assembly 5 includes a sliding sleeve 51, a first diagonal brace 52 and a second diagonal brace 53; the sliding sleeve 51 is slidably sleeved on the outer wall of the middle vertical rod 1 and can slide along the middle vertical rod 1; the first diagonal brace 52 and the second diagonal brace 53 are hinged to the left and right sides of the sliding sleeve 51, respectively; the end of the first diagonal brace 52 away from the sliding sleeve 51 is hinged to the first lower horizontal rod 2, and the end of the second diagonal brace 53 away from the sliding sleeve 51 is hinged to the second lower horizontal rod 3.

By sliding the sliding support base 4 and the sliding sleeve 51 to the lower end on the middle vertical rod 1, and swinging the first lower horizontal rod 2 and the second lower horizontal rod 3, the playpen frame is unfolded. The middle vertical rod 1 ensures the height of the playpen. The first lower horizontal rod 2 and the second lower horizontal rod 3 provide horizontal support for the playpen. Several triangular support structures are formed by the first diagonal brace 52 and the second diagonal brace 53 combined with the first lower horizontal rod 2 and the second lower horizontal rod 3, respectively, and these triangular structures offer stability to enhance the side stability of the entire playpen.

As shown in FIGS. 2 to 6, in this embodiment, the sliding sleeve 51 is provided with a first locking structure 6. The first locking structure 6 is used to lock the sliding sleeve 51 on the middle vertical rod 1, or unlock the sliding sleeve 51 and the middle vertical rod 1. When the playpen is fully unfolded, the user operates the first locking structure 6 so that the first locking structure between the sliding sleeve 51 and the middle vertical rod 1 fixes the position of the sliding sleeve 51 to prevent the playpen structure from accidentally moving or collapsing due to unintentional collision or external force, thereby improving the safety of the playpen. In addition, when folding or unfolding one side of the playpen, the first locking structure 6 is designed to fold or unfold the other side, thereby improving the folding efficiency.

Figure 5:
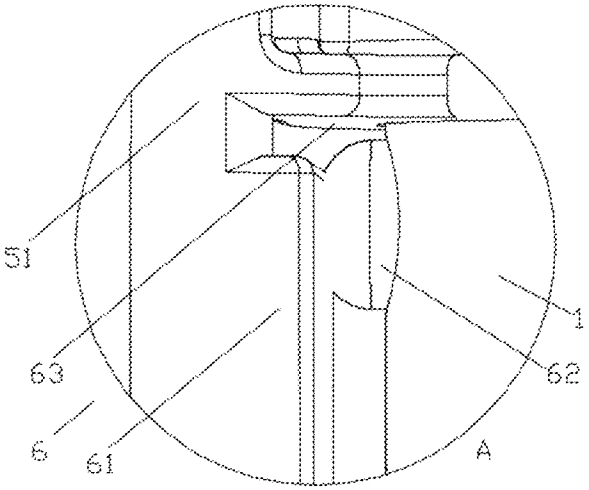
FIG. 5 is an enlarged view showing the portion A in FIG. 3.

As shown in FIGS. 2 to 6, in this embodiment, the sliding sleeve 51 is slidably connected to the middle vertical rod 1 through the second sliding groove 511 inside the sliding sleeve 51. The side of the second sliding groove 511 is provided with an opening. The sliding sleeve 51 is provided with a stopper 63 beside the position of the opening of the second sliding groove 511, and the sliding sleeve 51 is provided with a first elastic sheet 61 beside the position of the opening the second sliding groove 511. FIG. 5 shows that the first elastic sheet 61 is located below the stopper 63. The middle vertical rod 1 is provided with a first elastic part 62 that can be extended and retracted in the horizontal direction. The stopper 63, the first elastic sheet 61 and the first elastic part 62 form the first locking structure 6, wherein the first elastic part 62 protrudes to the outside of the middle vertical rod 1 and presses against the stopper 63 without external force, so as to achieve the locking function. When the sliding sleeve 51 is locked on the middle vertical rod 1, the first elastic sheet 61 is placed corresponding to the first elastic part 62, and the first elastic sheet 61 is pressed to push the first elastic part 62 into the middle vertical rod 1 to achieve the unlocking function, that is, to release the stopper 63. After that, the sliding sleeve 51 can slide along the middle vertical rod 1 or be removed. The elastic part automatically locks without external force, which avoids unlocking due to negligence, and eliminates the safety hidden danger. The elastic sheet is pressed to achieve unlocking, and such an operation is simple, quick, and user-friendly.

Figure 6:
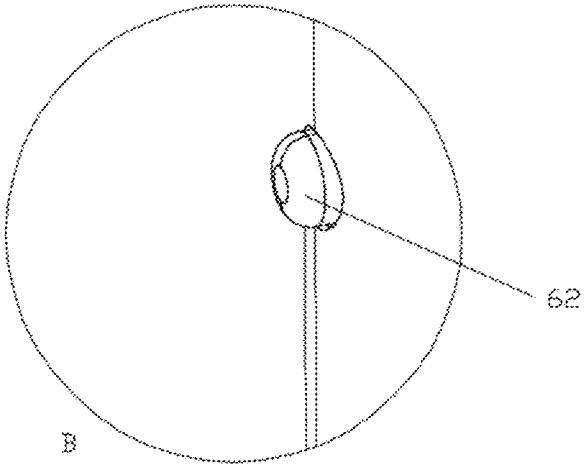
FIG. 6 is an enlarged view showing the portion B in FIG. 2.

As shown in FIG. 6, in this embodiment, the first elastic part 62 includes a first protrusion (the portion shown in FIG. 6) and a first elastic structure. The first elastic structure is a V-shaped elastic sheet, having one end pressing against the inside of the middle vertical rod 1 and the other end fixed with the first protrusion. The first protrusion can protrude outside the middle vertical rod 1 to press against the stopper 63. The first elastic structure plays a resetting role, and provides elastic force to drive the first protrusion to protrude outside the middle vertical rod 1, so as to facilitate contact with the stopper 63 later.

In this embodiment, there are at least two first elastic parts 62 that are arranged on the upper and lower sides of the middle vertical rod 1, respectively. The first elastic part 62 located on the lower side of the middle vertical rod 1 corresponds to the unfolding locking point, and plays a locking role after the playpen is unfolded. This locking structure ensures the stability and safety of the playpen during use, and prevents accidental folding or movement due to external forces. The first elastic part 62 located on the upper side of the middle vertical rod 1 corresponds to the folding locking point, and plays a locking role after the playpen is folded. This ensures the compactness and portability of the playpen in the folded state, and prevents accidental unfolding during transportation or storage.

As shown in FIGS. 2, 7 to 9, in this embodiment, the sliding support base 4 is provided with a second locking structure 7. The second locking structure 7 is used to lock the sliding support base 4 on the middle vertical rod 1, or unlock the sliding support base 4 and the middle vertical rod 1, which can prevent the playpen structure from accidentally moving or collapsing due to unintentional collision or external force, and improves the safety of the playpen. In addition, when one side of the playpen is folded or unfolded, the second locking structure 7 is designed to fold or unfold the other side, thereby improving the folding efficiency.

Figure 7:
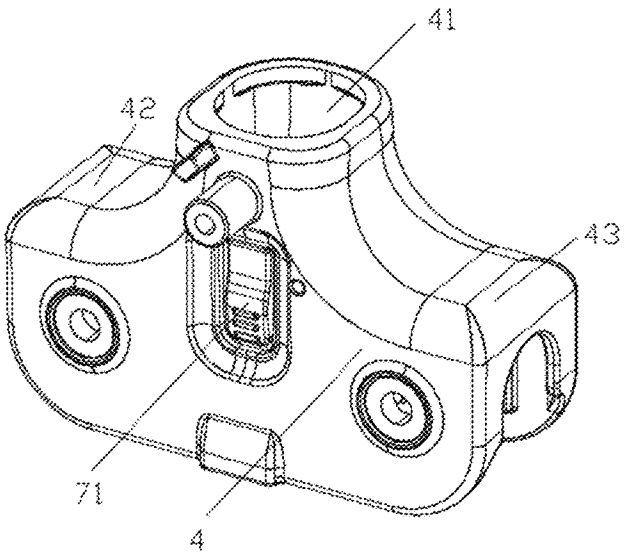
FIG. 7 is a first structural schematic diagram of a sliding support base in this embodiment.
Figure 8:
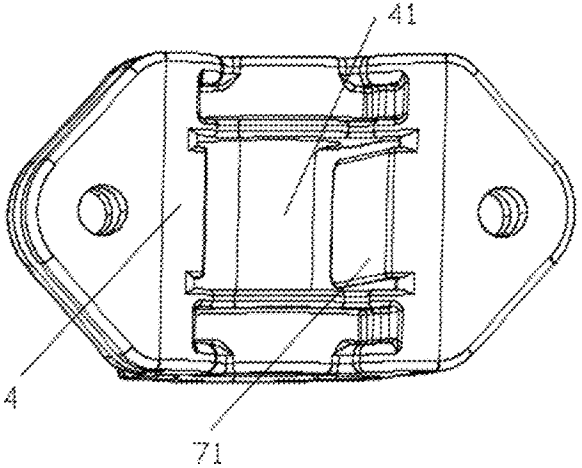
FIG. 8 is a second structural schematic diagram of the sliding support base in this embodiment.

As shown in FIGS. 7 and 8, in this embodiment, the side of the first sliding groove 41 is provided with an opening, and the sliding support base 4 is provided with a second elastic sheet 71 beside the opening of the first sliding groove 41. The middle vertical rod 1 is provided with a second elastic part 72 that can be extended and retracted in the horizontal direction. The second elastic sheet 71 and the second elastic part 72 form the second locking structure 7, wherein the second elastic part 72 protrudes to the outside of the middle vertical rod 1 and presses against the second elastic sheet 71 without external force, so as to achieve the locking function. When the sliding support base 4 is locked on the middle vertical rod 1, the second elastic sheet 71 is placed corresponding to the second elastic part 72, and the second elastic sheet 71 is pressed to push the second elastic part 72 into the middle vertical rod 1 to achieve the unlocking function.

The second elastic part 72 automatically extends without external force, and a second protrusion of the second elastic part 72 presses against the second elastic sheet 71, thereby locking the sliding support base 4. When the position of the sliding support base 4 needs to be adjusted or the sliding support base 4 needs to be completely removed, the user presses the second elastic sheet 71 to push the second elastic part 72 into the middle vertical rod 1, and then releases the second elastic sheet 71 to unlock the sliding support base 4.

Figure 9:
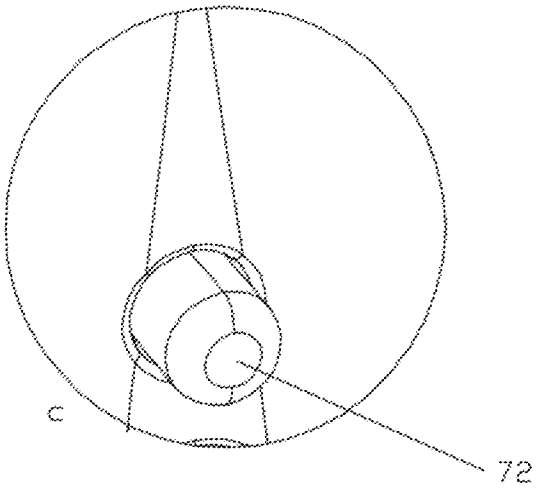
FIG. 9 is an enlarged view showing portion C in FIG. 2.

As shown in FIG. 9, in this embodiment, the second elastic part 72 includes a second protrusion (the portion shown in FIG. 9) and a second elastic structure. The second elastic structure is a V-shaped elastic sheet, having one end pressing against the inside of the middle vertical rod 1, and the other end fixed with a second protrusion. The second protrusion can protrude outside the middle vertical rod 1 to press against the second elastic sheet 71. The second elastic structure plays a resetting role, and provides elastic force to drive the second protrusion to extend outside the middle vertical rod 1.

Figure 10:
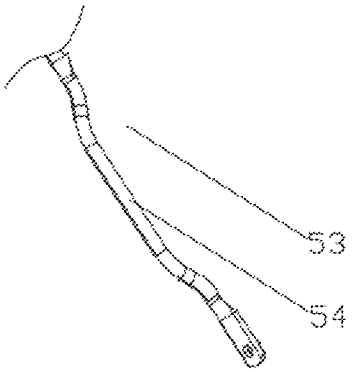
FIG. 10 is a structural schematic diagram of a second diagonal brace in this embodiment.

As shown in FIG. 10, in this embodiment, a trapezoidal handle structure 54 is provided in the middle of the first diagonal brace 52 and the second diagonal brace 53. The trapezoidal handle structure 54 protrudes toward the outside of the side structure (the inside corresponds to the inside of the playpen after it is unfolded, and the outside corresponds to the outside of the playpen after it is unfolded), providing a larger contact surface for users to hold.

As shown in FIG. 7, in this embodiment, a first limiting wall 42 is provided above the portion where the sliding support base 4 is hinged to the first lower horizontal rod 2. The first limiting wall 42 limits the first lower horizontal rod 2 from rotating upward so that the first lower horizontal rod 2 is arranged horizontally after the playpen is unfolded. A second limiting wall 43 is provided above the portion wherein the sliding support base 4 is hinged to the second lower horizontal rod 3. The second limiting wall 43 limits the second lower horizontal rod 3 from rotating upward so that the second lower horizontal rod 3 is arranged horizontally after the playpen is unfolded. FIG. 7 shows that the shape of the sliding support base 4 is designed to be convex, and the first limiting wall 42 and the second limiting wall 43 are provided at the left and right ends of the sliding support base 4. The limiting walls limit the rotation of the horizontal rod, which ensures that the horizontal rods can be stably arranged in the horizontal direction after being unfolded, and reduces the risk of accidental flipping of the horizontal rod.

Figure 2:
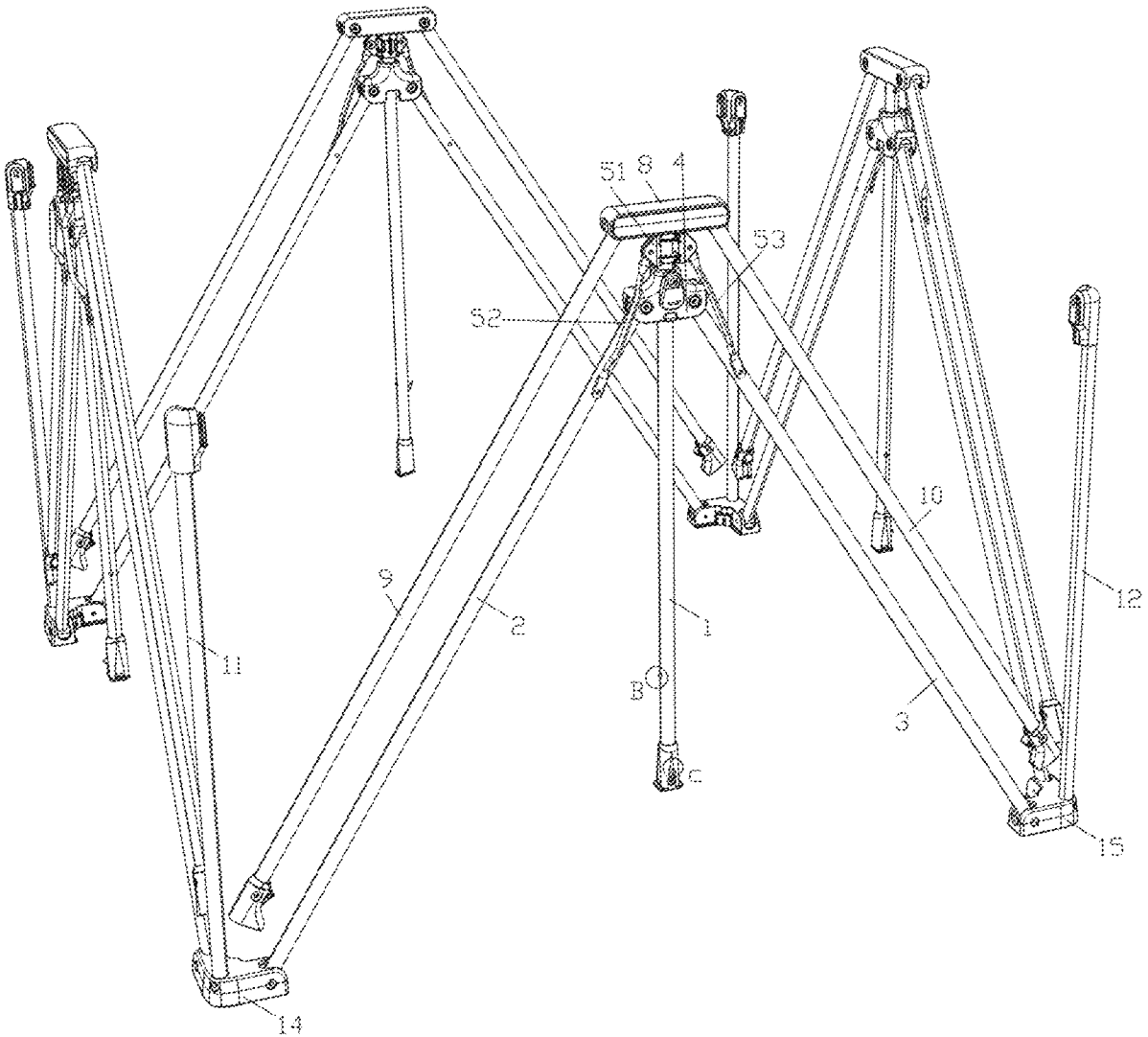
FIG. 2 is a structural schematic diagram of a playpen in a folded configuration in this embodiment.
Figure 3:
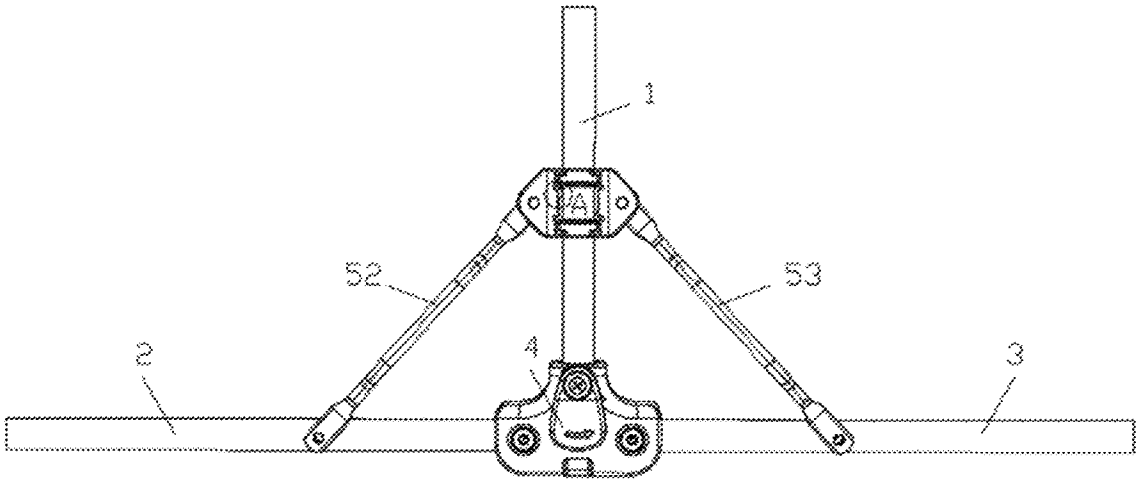
FIG. 3 is a structural schematic diagram of a part of a side structure in this embodiment.
Figure 4:
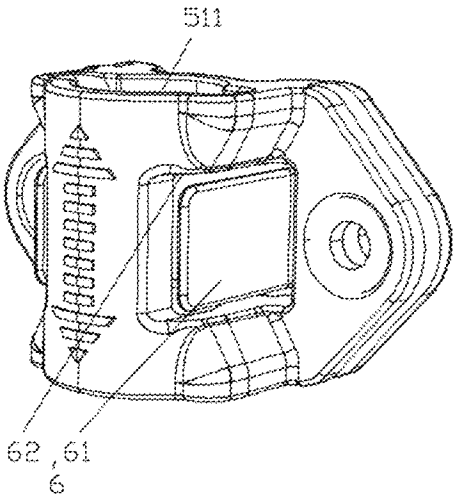
FIG. 4 is a structural schematic diagram of a sliding sleeve in this embodiment.

As shown in FIGS. 1 and 2, in this embodiment, the side structure further includes a middle connecting part 8, a first upper horizontal rod 9, a second upper horizontal rod 10, a first vertical rod 11, a second vertical rod 12, a first upper connecting part 13, a first lower connecting part 14, a second upper connecting part 15, and a second lower connecting part 16. The first upper horizontal rod 9 and the second upper horizontal rod 10 are hinged to the left and right sides of the middle connecting part 8. The upper end of the first vertical rod 11 is hinged to the end of the first upper horizontal rod 9 away from the middle connecting part 8 through the first upper connecting part 13. The lower end of the first vertical rod 11 is hinged to the end of the first lower horizontal rod 2 away from the sliding support base 4 through the first lower connecting part 14. The upper end of the second vertical rod 12 is hinged to the end of the second upper horizontal rod 10 away from the middle connecting part 8 through the second upper connecting part 15. The lower end of the second vertical rod 12 is hinged to the end of the second lower horizontal rod 3 away from the sliding support base 4 through the second lower connecting part 16. The hinge design allows the various components to move within a certain range, which facilitates the unfolding and folding of the playpen for easy use.

As shown in FIGS. 1 to 10, this embodiment also provides a playpen frame, including four side structures of a playpen frame as described in any of the above embodiments, wherein two adjacent side structures share a first upper connecting part 13, a first lower connecting part 14, a second upper connecting part 15, a second lower connecting part 16, a first vertical rod 11, and a second vertical rod 12, and the four side structures are unfolded to form a shape of a cube.

Through the interconnection of the four side structures, the playpen frame forms a stable cubic structure when unfolded, providing sufficient support and stability. In the folded state, the playpen frame can be compactly folded for easy storage and transportation. In the unfolded state, the playpen frame can be quickly unfolded to form the required playpen space. The stable playpen frame provides a safer playing environment for children and reduces the possibility of accidents.

As shown in FIGS. 1 to 10, this embodiment further provides a playpen, including the playpen frame described in any of the above embodiments and a fabric cover covering the sides and bottom of the playpen frame.

It should be noted that, in this application, relational terms, such as first and second, etc., are only used to distinguish one component or operation from another component or operation, and do not require or imply any actual relationship or sequence between these components or operations. Moreover, the terms "include", "include" or the like are intended to indicate non-exclusive inclusion, so that the process, method, article or terminal device including a series of elements includes not only those elements, but also other elements not explicitly listed, or also includes elements inherent to such process, method, article or terminal device. Without further restrictions, the elements defined by the statement "include . . . " or "include . . . " do not exclude the existence of other elements in the process, method, article or terminal device including the elements. Furthermore, in this application, "greater than", "less than", "exceed" and the likes are understood to exclude the number itself; "above", "below", "within" and the likes are understood to include the number itself.

Though the above has described each embodiment, the person skilled in the art who knows the basic creative concept can make additional changes and modifications to these embodiments. Therefore, the above description is only the embodiment of the present invention, and it does not limit the patent protection scope of the present invention. Any equivalent structure or equivalent process transformation made by using the contents of specification and drawings of the present invention, or direct or indirect use in other related technical fields, are also included in the patent protection scope of the present invention.

The invention claimed is:

1. A side structure of a playpen frame, comprising:

a middle vertical rod, wherein the middle vertical rod is arranged vertically after being unfolded;

a first lower horizontal rod, wherein the first lower horizontal rod is arranged horizontally after being unfolded;

a second lower horizontal rod, wherein the second lower horizontal rod is arranged horizontally after being unfolded;

a sliding support base, wherein a first sliding groove slidably connected to the middle vertical rod is provided in a middle of the sliding support base, the sliding support base is allowed to slide along the middle vertical rod, and the first lower horizontal rod and the second lower horizontal rod are hinged to left and right sides of the sliding support base; and a triangular support sliding assembly, wherein the triangular support sliding assembly includes a sliding sleeve, a first diagonal brace and a second diagonal brace, the sliding sleeve is slidably connected to the outer wall of the middle vertical rod and can slide along the middle vertical rod, the first diagonal brace and the second diagonal brace are hinged to left and right sides of the sliding sleeve, one end of the first diagonal brace away from the sliding sleeve is hinged to the first lower horizontal rod, and one end of the second diagonal brace away from the sliding sleeve is hinged to the second lower horizontal rod.

2. The side structure according to claim 1, wherein a trapezoidal handle structure protruding toward an outside of the side structure is provided between the first diagonal brace and the second diagonal brace.

3. The side structure according to claim 1, wherein a first limiting wall is provided above a portion where the first lower horizontal rod is hinged to the sliding support base; the first limiting wall limits the first lower horizontal rod from turning upward so that the first lower horizontal rod is arranged horizontally after being unfolded; a second limiting wall is provided above a portion where the second lower horizontal rod is hinged to the sliding support base; the second limiting wall limits the second lower horizontal rod from turning upward so that the second lower horizontal rod is arranged horizontally after being unfolded.

4. The side structure according to claim 1, wherein a first locking structure is provided on the sliding sleeve, and the first locking structure is configured to lock the sliding sleeve on the middle vertical rod, or unlock the sliding sleeve and the middle vertical rod.

5. The side structure according to claim 4, wherein the sliding sleeve is slidably connected to the middle vertical rod through a second sliding groove inside the sliding sleeve, a side of the second sliding groove is provided with an opening, the sliding sleeve is provided with a stopper beside a position of the opening of the second sliding groove, the sliding sleeve is provided with a first elastic sheet beside the position of the opening of the second sliding groove, the middle vertical rod is provided with a first elastic part allowed to extend and retract in a horizontal direction, and the stopper, the first elastic sheet, and the first elastic part form the first locking structure;

wherein, the first elastic part protrudes outside the middle vertical rod and presses against the stopper without external force to achieve a locking function;

when the sliding sleeve is locked on the middle vertical rod, the first elastic sheet is placed corresponding to the first elastic part, and the first elastic sheet is pressed to push the first elastic part into the middle vertical rod to achieve an unlocking function.

6. The side structure according to claim 5, wherein the first elastic part comprises a first protrusion and a first elastic structure; the first elastic structure is a V-shaped elastic sheet, one end of the first elastic structure presses against the middle vertical rod, and the other end of the first elastic structure is fixed with the first protrusion; the first protrusion is allowed to protrude outside the middle vertical rod to press against the stopper.

7. The side structure according to claim 5, wherein at least two first elastic parts are provided, and are respectively arranged on upper and lower sides of the middle vertical rod.

8. The side structure according to claim 1, wherein a second locking structure is provided on the sliding support base, and the second locking structure is configured to lock the sliding support base on the middle vertical rod, or unlock the sliding support base and the middle vertical rod.

9. The side structure according to claim 8, wherein a side of the first sliding groove is provided with an opening, the sliding support base is provided with a second elastic sheet beside a position of the opening of the first sliding groove, the middle vertical rod is provided with a second elastic part allowed to extend and retract in a horizontal direction, and the second elastic sheet and the second elastic part form the second locking structure;

wherein, the second elastic part protrudes outside the middle vertical rod and presses against the second elastic sheet without external force to achieve a locking function; when the sliding support base is locked on the middle vertical rod, the second elastic sheet is placed corresponding to the second elastic part, and the second elastic sheet is pressed to push the second elastic part into the middle vertical rod to achieve an unlocking function.

10. The side structure according to claim 1, further comprising a middle connecting part, a first upper horizontal rod, a second upper horizontal rod, a first vertical rod, a second vertical rod, a first upper connecting part, a first lower connecting part, a second upper connecting part and a second lower connecting part, wherein the first upper horizontal rod and the second upper horizontal rod are hinged to left and right sides of the middle connecting part, an upper end of the first vertical rod is hinged to an end of the first upper horizontal rod away from the middle connecting part through the first upper connecting part, a lower end of the first vertical rod is hinged to an end of the first lower horizontal rod away from the sliding support base through the first lower connecting part, an upper end of the second vertical rod is hinged to an end of the second upper horizontal rod away from the middle connecting part through the second upper connecting part, and a lower end of the second vertical rod is hinged to an end of the second lower horizontal rod away from the sliding support base through the second lower connecting part.

11. A playpen frame, comprising four side structures of the playpen frame according to claim 10, wherein two adjacent side structures share one first upper connecting part, one first lower connecting part, one second upper connecting part, one second lower connecting part, one first vertical rod, and one second vertical rod, and the four side structures are unfolded to form a cubic shape.

12. A playpen, comprising the playpen frame according to claim 11 and a fabric cover covering a bottom and sides of the playpen frame.

13. The side structure according to claim 2, further comprising a middle connecting part, a first upper horizontal rod, a second upper horizontal rod, a first vertical rod, a second vertical rod, a first upper connecting part, a first lower connecting part, a second upper connecting part and a second lower connecting part, wherein the first upper horizontal rod and the second upper horizontal rod are hinged to left and right sides of the middle connecting part, an upper end of the first vertical rod is hinged to an end of the first upper horizontal rod away from the middle connecting part through the first upper connecting part, a lower end of the first vertical rod is hinged to an end of the first lower horizontal rod away from the sliding support base through the first lower connecting part, an upper end of the second vertical rod is hinged to an end of the second upper horizontal rod away from the middle connecting part through the second upper connecting part, and a lower end of the second vertical rod is hinged to an end of the second lower horizontal rod away from the sliding support base through the second lower connecting part.

14. The side structure according to claim 3, further comprising a middle connecting part, a first upper horizontal rod, a second upper horizontal rod, a first vertical rod, a second vertical rod, a first upper connecting part, a first lower connecting part, a second upper connecting part and a second lower connecting part, wherein the first upper horizontal rod and the second upper horizontal rod are hinged to left and right sides of the middle connecting part, an upper end of the first vertical rod is hinged to an end of the first upper horizontal rod away from the middle connecting part through the first upper connecting part, a lower end of the first vertical rod is hinged to an end of the first lower horizontal rod away from the sliding support base through the first lower connecting part, an upper end of the second vertical rod is hinged to an end of the second upper horizontal rod away from the middle connecting part through the second upper connecting part, and a lower end of the second vertical rod is hinged to an end of the second lower horizontal rod away from the sliding support base through the second lower connecting part.

15. The side structure according to claim 4, further comprising a middle connecting part, a first upper horizontal rod, a second upper horizontal rod, a first vertical rod, a second vertical rod, a first upper connecting part, a first lower connecting part, a second upper connecting part and a second lower connecting part, wherein the first upper horizontal rod and the second upper horizontal rod are hinged to left and right sides of the middle connecting part, an upper end of the first vertical rod is hinged to an end of the first upper horizontal rod away from the middle connecting part through the first upper connecting part, a lower end of the first vertical rod is hinged to an end of the first lower horizontal rod away from the sliding support base through the first lower connecting part, an upper end of the second vertical rod is hinged to an end of the second upper horizontal rod away from the middle connecting part through the second upper connecting part, and a lower end of the second vertical rod is hinged to an end of the second lower horizontal rod away from the sliding support base through the second lower connecting part.

16. The side structure according to claim 5, further comprising a middle connecting part, a first upper horizontal rod, a second upper horizontal rod, a first vertical rod, a second vertical rod, a first upper connecting part, a first lower connecting part, a second upper connecting part and a second lower connecting part, wherein the first upper horizontal rod and the second upper horizontal rod are hinged to left and right sides of the middle connecting part, an upper end of the first vertical rod is hinged to an end of the first upper horizontal rod away from the middle connecting part through the first upper connecting part, a lower end of the first vertical rod is hinged to an end of the first lower horizontal rod away from the sliding support base through the first lower connecting part, an upper end of the second vertical rod is hinged to an end of the second upper horizontal rod away from the middle connecting part through the second upper connecting part, and a lower end of the second vertical rod is hinged to an end of the second lower horizontal rod away from the sliding support base through the second lower connecting part.

17. The side structure according to claim 6, further comprising a middle connecting part, a first upper horizontal rod, a second upper horizontal rod, a first vertical rod, a second vertical rod, a first upper connecting part, a first lower connecting part, a second upper connecting part and a second lower connecting part, wherein the first upper horizontal rod and the second upper horizontal rod are hinged to left and right sides of the middle connecting part, an upper end of the first vertical rod is hinged to an end of the first upper horizontal rod away from the middle connecting part through the first upper connecting part, a lower end of the first vertical rod is hinged to an end of the first lower horizontal rod away from the sliding support base through the first lower connecting part, an upper end of the second vertical rod is hinged to an end of the second upper horizontal rod away from the middle connecting part through the second upper connecting part, and a lower end of the second vertical rod is hinged to an end of the second lower horizontal rod away from the sliding support base through the second lower connecting part.

18. The side structure according to claim 7, further comprising a middle connecting part, a first upper horizontal rod, a second upper horizontal rod, a first vertical rod, a second vertical rod, a first upper connecting part, a first lower connecting part, a second upper connecting part and a second lower connecting part, wherein the first upper horizontal rod and the second upper horizontal rod are hinged to left and right sides of the middle connecting part, an upper end of the first vertical rod is hinged to an end of the first upper horizontal rod away from the middle connecting part through the first upper connecting part, a lower end of the first vertical rod is hinged to an end of the first lower horizontal rod away from the sliding support base through the first lower connecting part, an upper end of the second vertical rod is hinged to an end of the second upper horizontal rod away from the middle connecting part through the second upper connecting part, and a lower end of the second vertical rod is hinged to an end of the second lower horizontal rod away from the sliding support base through the second lower connecting part.

19. The side structure according to claim 8, further comprising a middle connecting part, a first upper horizontal rod, a second upper horizontal rod, a first vertical rod, a second vertical rod, a first upper connecting part, a first lower connecting part, a second upper connecting part and a second lower connecting part, wherein the first upper horizontal rod and the second upper horizontal rod are hinged to left and right sides of the middle connecting part, an upper end of the first vertical rod is hinged to an end of the first upper horizontal rod away from the middle connecting part through the first upper connecting part, a lower end of the first vertical rod is hinged to an end of the first lower horizontal rod away from the sliding support base through the first lower connecting part, an upper end of the second vertical rod is hinged to an end of the second upper horizontal rod away from the middle connecting part through the second upper connecting part, and a lower end of the second vertical rod is hinged to an end of the second lower horizontal rod away from the sliding support base through the second lower connecting part.

20. The side structure according to claim 9, further comprising a middle connecting part, a first upper horizontal rod, a second upper horizontal rod, a first vertical rod, a second vertical rod, a first upper connecting part, a first lower connecting part, a second upper connecting part and a second lower connecting part, wherein the first upper horizontal rod and the second upper horizontal rod are hinged to left and right sides of the middle connecting part, an upper end of the first vertical rod is hinged to an end of the first upper horizontal rod away from the middle connecting part through the first upper connecting part, a lower end of the first vertical rod is hinged to an end of the first lower horizontal rod away from the sliding support base through the first lower connecting part, an upper end of the second vertical rod is hinged to an end of the second upper horizontal rod away from the middle connecting part through the second upper connecting part, and a lower end of the second vertical rod is hinged to an end of the second lower horizontal rod away from the sliding support base through the second lower connecting part.

* * * * *